United States Patent [19]

Museki

[11] 4,417,437

[45] Nov. 29, 1983

[54] WATCHBAND FORMED OF TUBULAR METAL RODS AND METHOD OF MANUFACTURING SAME

[75] Inventor: Katsuo Museki, Tokyo, Japan

[73] Assignee: Kabushiki Kaisha Daini Seikosha, Tokyo, Japan

[21] Appl. No.: 264,843

[22] Filed: May 18, 1981

[30] Foreign Application Priority Data

May 19, 1980 [JP] Japan ..... 55-68465[U]

[51] Int. Cl.[3] ..... B21L 11/00; F16G 13/18

[52] U.S. Cl. ..... 59/20; 59/80; 59/83; 59/35 R; 63/4

[58] Field of Search ..... 59/80, 82, 83, 78, 35.1, 59/20, 12, 10, 79.1, 79.2; 63/4, 2; 224/164, 178, 19

[56] References Cited

U.S. PATENT DOCUMENTS

| | | | |
|---|---|---|---|
| 2,087,479 | 7/1937 | Quisling | 59/78 |
| 2,498,211 | 2/1950 | Kreisler | 59/35 |
| 4,089,161 | 5/1978 | Aoki | 59/80 |

FOREIGN PATENT DOCUMENTS

| | | | |
|---|---|---|---|
| 2500980 | 7/1976 | Fed. Rep. of Germany | 59/80 |
| 832911 | 7/1938 | France | 63/2 |
| 1313180 | 11/1962 | France | 59/79 R |

*Primary Examiner*—Gene Crosby

*Attorney, Agent, or Firm*—Robert E. Burns; Emmanuel J. Lobato; Bruce L. Adams

[57] ABSTRACT

A watchband is comprised of a plurality of interconnected segments of generally helical shape. The segments are formed of tubular metal rods which may be composed of a noble metal alloy, a copper alloy or stainless steel. The use of tubular metal rods as opposed to solid metal rods results in a reduction in materials costs and a lighter weight watchband. The watchband is manufactured by winding a tubular metal rod on a mandrel into a generally helical shape, cutting the helically-wound tubular metal rod to predetermined lengths, and connecting together the lengths in lengthwise juxtaposition so that the coils of one length partly overlie the coils of adjoining lengths to thereby form a watchband comprised of interconnected tubular metal rod segments. By using tubular as opposed to solid metal rods, the annealing process normally required in order to wind the rod into helical shape can be eliminated.

14 Claims, 4 Drawing Figures

WATCHBAND FORMED OF TUBULAR METAL RODS AND METHOD OF MANUFACTURING SAME

BACKGROUND OF THE INVENTION

The present invention pertains generally to portable watchbands for wristwatches and more particularly, to watchbands comprised of similarly-shaped metal segments connected together in a mesh or chain configuration.

Conventional watchbands of this general type comprise a succession of connected-together metal segments each formed of a solid metal rod bent into the desired shape. The solid metal rods usually have a helical shape and are connected together such that the coils of one rod partly overlie the coils of adjoining rods.

The bending of the solid metal rod into a helical configuration is a time-consuming operation which, depending of the material, requires considerable skill and know-how. Metal watchbands in use today are usually comprised of solid metal rods formed of a noble metal, such as 18 karat or 14 karat gold alloy or a platinum alloy, a copper alloy and stainless steel. Due to the inherent nature of these materials, it is necessary to subject the solid metal rod to an annealing treatment in order to enable bending of the rod into the desired helical shape. The annealing also facilitates pressing or flattening of the band structure into a flat shape.

One drawback of the prior art metal watchbands is that because of the use of solid metal rods, the material cost is necessarily high. This is particularly disadvantageous when the band is formed of a noble metal alloy in view of the high cost of the noble metals. In addition, the use of solid metal rods increases the overall weight of the watchbands and this is particularly disadvantageous in the case of ultra-thin watches. Moreover, the use of solid metal rods increases production costs as the rods require annealing in order to permit cold working of the metal rods into the desired helical shape.

SUMMARY OF THE INVENTION

It is, therefore, one object of the present invention to provide a watchband and a method of manufacturing watchbands which overcome the aforementioned drawbacks prevalent in the prior art.

Another object of the present invention is to provide a metal watchband having the same size and exhibiting the same appearance as prior art watchbands though requiring less material than prior art watchbands.

A further object of the present invention is to provide a metal watchband which can be more easily and quickly manufactured than similarly-shaped prior art watchbands.

A still further object of the present invention is to provide a method of manufacturing metal watchbands using hollow tubular metal rods which can be bent into the desired helical shape without requiring an annealing process.

The above and other objects of the invention are achieved by a watchband comprised of a plurality of interconnected segments with each segment being formed of a hollow tubular metal rod. The watchband is manufactured by winding a hollow tubular metal rod into a generally helical shape without annealing the rod, cutting the helically-wound tubular metal rod to predetermined lengths, and connecting together the lengths of tubular metal rods so that the coils of one length partly overlie the coils of adjoining lengths to thereby form a watchband comprised of interconnected tubular metal rod segments.

Having in mind the above objects as well as other objects of the invention which will become apparent to those skilled in the art from a reading of this disclosure, the present invention comprises the metal watchband and the method of manufacturing the same as illustrated in the presently preferred embodiment which is hereinafter set forth in sufficient detail to enable those persons ordinarily skilled in the art to clearly understand the manner of making and using the invention when read in conjunction with accompanying drawings.

DETAILED DESCRIPTION OF PREFERRED EMBODIMENT OF THE INVENTION

Figure 1A:
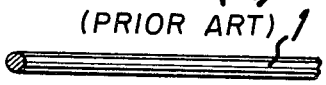
FIG. 1(A) (PRIOR ART)
FIG. 1(A) is a plan view, partly in section, of a solid metal rod used in a prior art watchband.
Figure 1B:
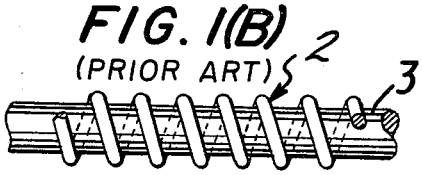
FIG. 1(B) (PRIOR ART)
FIG. 1(B) is a plan view, partly in section, showing the manner in which the solid metal rod is wound on a mandrel into a helical shape.

In order to facilitate a description of the present invention, a brief description will first be given of the prior art watchband constructions. Conventional watchbands of this general type are comprised of a plurality of interconnected segments each formed of a solid metal rod. FIG. 1(A) shows a conventional solid metal rod 1 comprised of a noble metal alloy, copper alloy or stainless steel. In order to enable bending of the solid metal rod 1 into the desired helical shape, it is necessary to anneal the rod after which, as shown in FIG. 1(B), the rod can be wound on a mandrel 3 into the desired helical shape 2. The helically-wound rod is then cut into predetermined lengths which are then connected together in the manner described hereinbelow with reference to FIG. 2(A) to form the watchband. As well known in the art, after the solid metal rod segments are connected together, the resulting structure is suitably pressed to flatten the coils to thereby obtain a flat watchband.

Figure 2A:
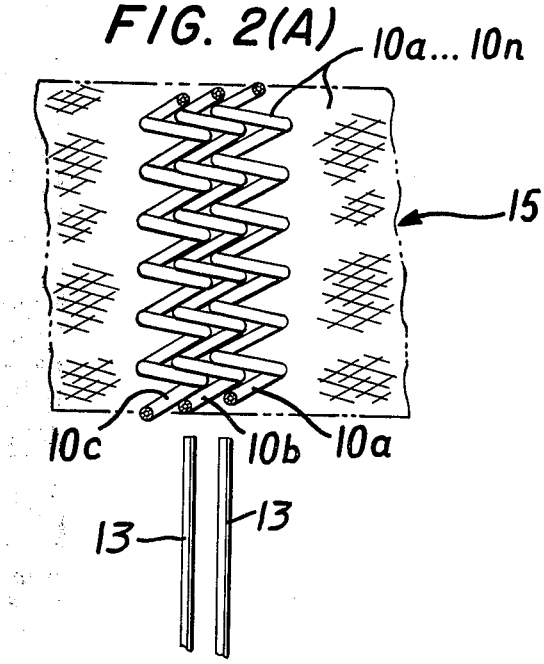
FIG. 2(A) is a plan view, partly enlarged for explanatory purposes, of a watchband constructed according to the present invention.
Figure 2B:
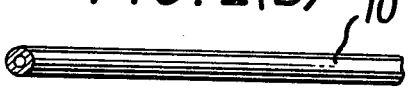
FIG. 2(B) is a plan view, partly in section, of a hollow tubular metal rod used in the watchband of the present invention.

A description of a watchband constructed according to the present invention will now be given with reference to FIGS. 2(A) and (B). The watchband of the invention is formed of hollow tubular metal rod segments as compared to the solid metal rod segments of the prior art. FIG. 2(B) shows a length of hollow tubular metal rod 10 which may consist of a noble metal alloy such as 18 karat or 14 karat gold alloy or a platinum alloy, a copper alloy or stainless steel. The hollow tubular metal rod 10 may have the same outer diameter as the prior art solid metal rod 1 shon in FIG. 1(A).

According to the method of the invention, the hollow tubular metal rod 10 is wound on a mandrel into a generally helical shape and then the helically-wound rod is cut into predetermined lengths to form watchband segments of the desired shape. The watchband segments 10*a*, 10*b*, 10*c* . . . 10*n* are then suitably connected together in lengthwise side-by-side juxtaposition as shown in FIG. 2(A). This type assembly of helical or convoluted segments is well known in the art and, therefore, a detailed description thereof is unnecessary. Briefly stated, the helical segments are placed side-by-side so that the coils or convolutions of one segment partly overlie the coils or convolutions of adjoining segments and pins 13 are inserted through the centers of the aligned coils of adjoining segments. After connecting together the helically-wound tubular metal rod segments, the watchband structure is then suitably pressed to flatten the coils to impart the desired flat shape to the watchband 15.

The use of hollow tubular metal rods for forming the watchband segments results in a reduction in material costs while achieving an increase in production speed at a lower production cost than is possible with use of segments formed of solid metal rods. Due to the hollow interior of the tubular metal rods, no annealing of the rods is necessary and in fact, annealing is detrimental in that it unduly softens the rod causng it to crack during winding thereof on the mandrel if excessive winding force is used. It has been found, however, that the same winding force used to helically wind solid metal rod, which has been annealed, can be used to wind similar-sized hollow tubular rod which has not been annealed as the ductility of the hollow metal rod without annealing approximates that of solid metal rod which has been annealed. Thus the watchband of the invention uses less material and can be manufactured moe quickly than prior art watchbands using solid metal rods thereby yielding watchbands of lighter weight though otherwise possessing the same outward appearance as the prior art watchbands.

Obvious changes and modifications will become apparent to those skilled in the art, and the present invention is intended to cover all such modifications and changes falling within the spirit and scope of the invention as defined in the appended claims.

I claim:

1. A method of manufacturing a watchband comprised of a plurality of interconnected segments comprising the steps of:

providing at least one hollow tubular metal rod;

winding the hollow tubular metal rod on a mandrel into a generally helical shape, the use of the hollow tubular metal rod enabling the winding step to be satisfactorily carried out without the need for annealing the hollow tubular metal rod either before or after winding thereof into a generally helical shape;

cutting the helically-wound hollow tubular metal rod to predetermined segment lengths; and connecting together the lengths of helically-wound hollow tubular metal rod so that the coils of one length partly overlie the coils of adjoining lengths to thereby form a watchband comprised of interconnected hollow tubular metal rod segments.

2. The watchband according to claim 1; wherein the hollow tubular metal rod is composed of a noble metal alloy.

3. The watchband according to claim 1; wherein the hollow tubular metal rod is composed of a copper alloy.

4. The watchband according to claim 1; wherein the hollow tubular metal rod is composed of stainless steel.

5. In a watchband of the type comprised of a series of elongate convoluted segments interconnected in lengthwise side-by-side relationship, the improvement wherein the elongate convoluted segments comprise hollow tubular metal rods which are formed into the shape of convoluted segments which retain their shape without annealing.

6. The watchband according to claim 5; wherein the hollow tubular metal rods have a generally helical shape.

7. The watchband according to claim 5; wherein the convolutions of the hollow tubular metal rods partly overlie the convolutions of adjoining hollow tubular metal rods.

8. The watchband according to claim 5; wherein the elongate convoluted segments comprise non-annealed hollow tubular metal rods.

9. The watchband according to claim 8; wherein the hollow tubular metal rods are composed of a noble metal alloy.

10. The watchband according to claim 8; wherein the hollow tubular metal rods are composed of a copper alloy.

11. The watchband according to claim 8; wherein the hollow tubular metal rods are composed of stainless steel.

12. The watchband according to claim 5; wherein the hollow tubular metal rods are composed of a noble metal alloy.

13. The watchband according to claim 5; wherein the hollow tubular metal rods are composed of a copper alloy.

14. The watchband according to claim 5; wherein the hollow tubular metal rods are composed of stainless steel.

* * * * *